United States Patent [19]

Grumet

[11] Patent Number: 4,716,417

[45] Date of Patent: Dec. 29, 1987

[54] AIRCRAFT SKIN ANTENNA

[75] Inventor: Alex Grumet, Whitestone, N.Y.

[73] Assignee: Grumman Aerospace Corporation, Bethpage, N.Y.

[21] Appl. No.: 701,141

[22] Filed: Feb. 13, 1985

[51] Int. Cl.[4] ..... H01Q 1/28

[52] U.S. Cl. ..... 343/708; 343/781 P; 342/2

[58] Field of Search ..... 343/18 B, 18 D, 18 E, 343/17, 705, 708; 342/1-10

[56] References Cited

U.S. PATENT DOCUMENTS

| | | | |
|---|---|---|---|
| 2,436,578 | 2/1948 | Korn et al. | 343/18 B |
| 3,487,410 | 12/1969 | Barnett et al. | 342/2 |
| 3,488,656 | 1/1970 | Anderson | 343/7 |
| 3,685,051 | 8/1972 | Wells | 343/17 |
| 3,699,574 | 10/1972 | O'Hara et al. | 343/705 X |
| 3,797,938 | 3/1974 | Heflinger et al. | 356/348 |
| 4,110,751 | 8/1978 | Reggia et al. | 343/700 MS |
| 4,119,968 | 10/1978 | Goldfischer | 343/351 |
| 4,214,807 | 7/1980 | Gfeller et al. | 350/3.73 |

FOREIGN PATENT DOCUMENTS 2952607 7/1980 Fed. Rep. of Germany .

OTHER PUBLICATIONS

J. Meyer-Arendt; *Intro. to Classical and Modern Optics*, pp. 416-417; 1972.

G. Mintz, "Holographic Simulation of Parabolic Mirrors"; *Applied Optics*, (vol. 14, No. 3, 3/75; pp. 564-565).

M. Skolnik; *Intro. to Radar Systems*, pp. 235-239; 1980.

Applied Optics, vol. 14, No. 7, Jul. 1975; L. G. Gregoris, et al., "Thermography in Microwave Holography", pp. 1487-1489.

Checcacci, et al., "Holographic Antennas", Proc. of IEEE, Dec. 1968, pp. 2165-2167.

K. Iizuka, "Microwave Hologram by Photoengraving", Proc. of IEEE 57, 813 (1969).

K. Iizuka, "Mapping of Electromagnetic Fields by Photochromics and their Application in Microwave Holography", J. Appl. Phys. 42, 5553 (1970).

G. Tricoles, et al., "Real-Time Holography with Microwaves and Millimeter Waves" Proc. Soc. Photo-Opt Instrum. Eng. 1980, vol. 231, SPIECJ 10-16-84.

K. Iizuka, "Review of Hologram Matrix Radars" Proc. Soc. Photo-Opt. Instrum. Eng. 1980, vol. 231 SPIECJ 10-16-84.

*Primary Examiner*—Theodore M. Blum

*Assistant Examiner*—Bernarr Earl Gregory

*Attorney, Agent, or Firm*—Scully, Scott, Murphy & Presser

[57] ABSTRACT

A holographic aircraft antenna and method of fabricating the antenna are disclosed herein. The antenna includes a thin layer of dielectric strips of material contoured to and mounted on the conductive skin of the aircraft or a plurality of thin metal conducting strips secured to the skin of a composite aircraft. The spacing, width and size of the thin strips forms a hologram which is determined by the interference pattern of radio frequency beams selected for and directed at a holographic recording medium at particular angles to provide a desired or series of desired radiation patterns. In addition, a radar reduction device is provided wherein the hologram includes thin strips of dielectric material on the conductive skin of the aircraft or thin metal conducting strips on the composite aircraft. The radar reduction hologram is mounted so that interrogating radar beams become entrapped surface waves directed longitudinally and along the axis of the wings thereby providing minimum reflection of the radar beam to reduce the size of the aircaraft detected by the radar apparatus.

50 Claims, 17 Drawing Figures

AIRCRAFT SKIN ANTENNA

BACKGROUND OF THE INVENTION

1. Field of the Invention

This invention relates to antennas, and more particularly, to antennas using holographic techniques for transmitting and receiving radiowaves.

2. Description of the Prior Art

Radio communications with an aircraft are plagued with dead spots in the radiation pattern. The design of the antenna on an aircraft always involves a compromise of weight and size to avoid interference with aircraft aerodynamics. For example, loop antennas are usually built into a pod that extends from the bottom of the aircraft presenting clearance problems. Rod antennas extend out from the skin of the aircraft much like a towel rod and are susceptible to breakage if icing is encountered. The prior art antennas that are appendages to the aircraft will result in blanking nulls which greatly reduces reception and transmission.

The present invention seeks to minimize the above concerns by providing an antenna that follows the surface configuration of the aircraft rather than being externally coupled to the aircraft. The antenna of the present invention utilizes holographic techniques to provide any desired radiation pattern or combination of patterns that are mounted to and part of the skin of the aircraft.

The use of holography in a manufacture of antennas is disclosed by Checcacci, et al. in an article entitled, "Holographic Antennas," published in Proceedings of IEEE, December 1968, pages 2165–2167. The interference pattern of a reference wave and a wave that provides the required radiation pattern is recorded from which a hologram can be constructed. A dipole antenna acts as the aperture of the interference absorbing screen. The hologram is constructed with variable attenuation or phase that has a profile equal to that of the recorded interference pattern (hologram). A major problem with the construction of the hologram is the elimination of the zero order wave.

A method of producing a hologram of a radio frequency source in space is disclosed in U.S. Pat. No. 3,488,656 issued to Anderson. A microwave source projects a plane wave toward the ground where a horn antenna is scanned along a series of straight lines detecting the incoming radiation of the microwave reference signal and the received radio frequency signal. The phase of the reference wave is compared with the phase of the radio frequency signal and the phase difference is recorded in the nature of an interference pattern. The recorded interference pattern is reduced in size on photographic film that can be viewed when illuminated by an RF source.

A satellite communication system using holographic techniques is disclosed in U.S Pat. No. 4,214,807 issued to Gfeller, et al. An optical transmitter directs a laser beam through a hologram to generate the desired multiple beam transmitter radiation pattern. The optical transmitter can be adjusted by providing several different holograms to generate different radiation patterns from the satellite. Each hologram is actuated by illuminating radiation from the transmitting laser which is selectively directed to the hologram at a particular angle. By defracting the laser radiations at the hologram, the wave fronts are reconstructed forming the desired field of the multi-beam radiation pattern. An optical antenna pattern of the optical transmitter is generated to transmit power to individual directional connections to selected earth stations.

SUMMARY OF THE INVENTION

The present invention provides an antenna particularly adaptable for use in connection with radio transmission and reception on board an airborn aircraft or spacecraft. The present invention utilizes the theory of holography in order to create an antenna that will operate with a minimum of dead spots in the radiation pattern. Furthermore, the holographic antenna can provide any desired radiation pattern or combinations of radiation patterns. The holographic aircraft antenna includes a thin layer of a dielectric material in the form of a hologram that is contoured to and mounted on the skin of the aircraft. The hologram consists of the interference pattern of two radio frequency beams that were recorded on a holographic film providing the desired radiation pattern. The spacing and width of the thin dielectric strips is determined by the particular interference pattern created by the two radio frequency beams recorded on the holographic recording medium. The dielectric strips are placed in conformance with the fringes of the interference pattern. Although the reconstruction of a holographic wave-front generally results in the entire playback beam being refracted out of the hologram, the hologram of the present invention is formed such that at least one component of the playback beam is reflected out of the hologram. It is this reflected beam that provides the desired radio transmission from the skin of the aircraft.

In accordance with the method of fabricating the holographic antenna, the hologram having the desired radiation pattern is formed by mounting a holographic recording medium to the skin of the aircraft and placing the aircraft in an anechoic chamber. A first radio frequency beam is directed onto the recording medium from one or more antennas mounted to the aircraft. A second radio frequency beam, from the same source of radio frequency, is directed to the recording medium from one or more antennas mounted to the walls of the anechoic chamber. The recording medium records the interference pattern of the first and second radio beams. The recorded interference pattern is converted to a dielectric pattern that is painted on the skin of the aircraft in the exact position it was recorded on the film. The fabricated hologram which is contoured to the body of the aircraft is mounted onto the skin of the aircraft and thereby becomes the aircraft antenna. In an alternative embodiment, the skin of the aircraft is the dielectric material. An example of the skin of the aircraft being made of a dielectric material is the expoxy skinned aircraft now being manufactured. The hologram could then be fabricated from a conductive holographic pattern sprayed on the aircraft or by securing metal conducting strips to the aircraft using the photographed hologram as a template.

A critical feature in the fabrication of the antenna is the angle of the first radio frequency beam with respect to a normal of the holographic recording medium. This angle must be selected so that there will be at least one component of the radio frequency beam to be transmitted that will be reflected out of the aircraft skin.

Any suitable optical mapping technique may be used such as mechanical scanning of an antenna, or techniques using temperature dependent chromatic film, or preexposed photographic color film.

An omnidirectional interference pattern can be formed by directing radio frequency beams from a plurality of wall mounted antennas that are arranged for equal signal strength from all directions toward the aircraft. In addition, phased arrays can be recorded to form a scanning interference pattern by sequentially exciting the wall mounted antennas onto a multi-exposure holographic recording film. Thus, radio frequency signals can be transmitted from the aircraft at various angles.

In accordance with another embodiment of the present invention a radar reduction feature is provided utilizing similar holographic techniques. In this embodiment, the hologram in the form of a plurality of dielectric thin strips are secured to the skin of the aircraft which forms a holographic refraction grating. The reception of a radar beam will result in a redirected wave along the skin of the aircraft (surface wave). Thus, a minimum reflection of the returned radar beam will provide no detection of the aircraft containing the radar reduction device.

Thus, there is provided a holographic antenna wherein all parts of the aircraft, except moving control surfaces and windshields, are part of the antenna rather than the externally coupled antennas of the prior art.

DETAILED DESCRIPTION OF THE INVENTION

Figure 1:
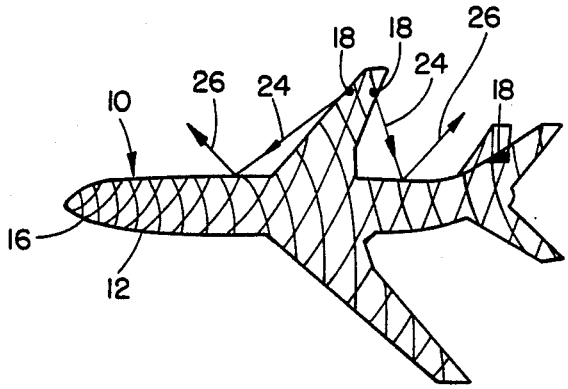
FIG. 1 is a schematic of an aircraft having the antenna of the present invention.
Figure 1A:
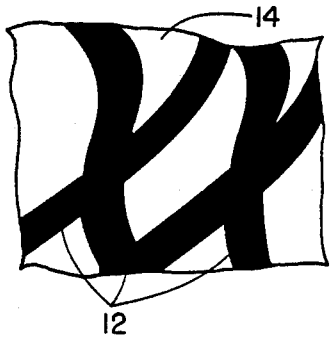
FIG. 1*a* is an enlarged schematic of a section of the holographic aircraft antenna of the present invention.
Figure 2:
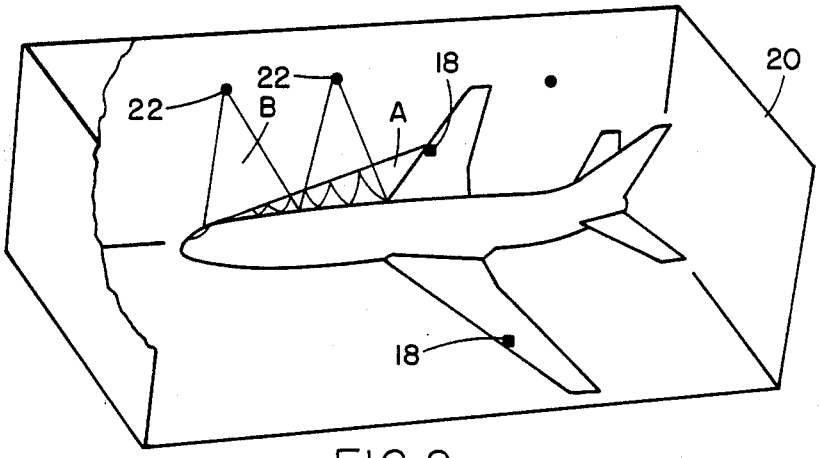
FIG. 2 shows schematically one method of recording the interference pattern of the hologram of the present invention.

The antenna of the present invention is shown in FIGS. 1, 1*a* and 2 and consists of a plurality of conducting dielectric thin strips 12 that are secured to the conductive skin of aircraft 16. The FIGS. 1, 1*a* and 2 are illustrative only and the invention should not be limited to the configurations shown. The spacing, width and shape of the strips form a hologram corresponding to the desired radiation pattern for the antenna. The antenna 10 consists of the holographically coated entire skin of the aircraft acting as a continuous phased array. The thin dielectric strips 12 are secured to the conductive aircraft skin 14 corresponding to the fringes of an interference pattern of two intersecting beams of radio frequency waves.

FIG. 1*a* shows a detailed enlarged view of a section of the antenna 10 showing a width and spacing arrangement. In a preferred embodiment, thin dielectric strips 12 are embedded within the conductive aircraft skin 14. The antenna 10 is a reciprocal device which can be used for transmission or reception.

In transmission operation, one or more feed horns or dipoles 18 mounted on the wings or the fuselage will direct a radio frequency wave indicated by arrows 24 at the skin of the aircraft which will result in the transmission of the radio frequency signal indicated by arrows 26 reflected out of the hologram providing the desired radiation pattern. For reception, the same dipoles or horns 18 will be connected to the microwave receiver.

The holographic antenna of the present invention is limited to a band of frequencies, from approximately 10 Mhz to the Giga hertz range. At the upper frequency end of the band the short wavelength is a limitation, because any relative motion of the aircraft such as wings sagging or fluttering in flight by one half a wavelength will negate the hologram and interfere with the antenna operation. The effect of half wavelength motion of a portion of the aircraft will simply remove that area from the effective antenna aperture of the holographic antenna described herein. At the lower frequency end of the band width or long wavelength, the interference strips will be farther apart, and there will be less of them on the aircraft. The effect of this on antenna operation will be weaker, noisier operation with possible broader beams and larger minor lobes.

Figure 3A:
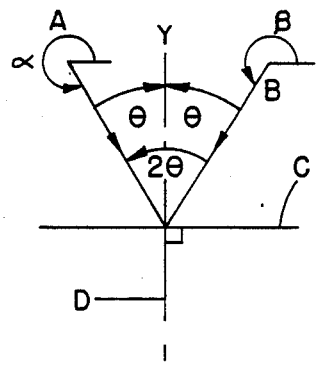
FIGS. 3*a* and 3*b* are vector diagrams showing the recording of the interference pattern and the subsequent reconstruction of that pattern for transmission.

In accordance with holographic theory, the interference of any two coherent beams that are phase locked to each other can result in a stationary interference pattern. FIG. 3*a* shows the holographic recording of two such beams labeled A and B on a holographic film C. The arrow associated with each beam is the direction of propagation. In any transverse plane to each of these propagation vectors the amplitude and phase is a function of the coordinates in that plane. Therefore, A and B are complex phasors of the electric field of the beam. For the purpose of illustrating the invention in the following description, the angle between vectors A and B will always be specified as $2\theta$ in this application and may (but need not) be divided equally by the normal D to the holographic film plane. From FIG. 3*a*, we see that the vectors A and B can be expressed as an amplitude and direction:

$$A=|A|\angle\alpha \quad B=|B|\angle\beta \tag{1}$$

where $|A|$ is the magnitude of A and $\alpha$ is its direction measured for the x axis. Similarly, $|B|$ is the magnitude of B and $\beta$ is its direction angle. The angles $\alpha$ and $\beta$ can be expressed as $$\alpha=270+\theta$$

$$\beta=270-\theta$$

The x axis will be defined in the holographic recording plane so that the problems can be reduced to two dimensions without any loss in generality.

The holographic film responds to energy and will record the hologram given by equation (2).

$$|A+B|^2=(A+B)(A+B)^*=AA^*+BB^*+AB^*+A^*B$$
$$=A^2\angle 0+|B|^2\angle 0+|A|\ |B|\angle\alpha-\beta+|A|$$
$$|B|\angle\beta-\alpha \quad (2)$$

The transmission of an electromagnetic wave through the developed holographic film is proportional to the recorded interference pattern. If we now illuminate the hologram with beam A alone, and if we consider the proportionality constant to be unity, the output of the hologram is seen to be:

$$A|A+B|^2=|A|^3\angle\alpha+|A|$$
$$|B|^2\angle\alpha+|A|^2|B|\angle 2\alpha-\beta+|A|^2|B|\angle\beta \quad (3)$$

Figure 3B:
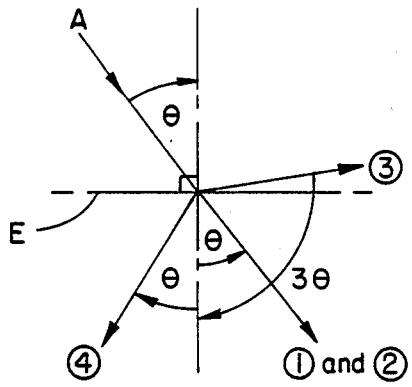

FIG. 3*b* shows the 4 components, of equation (3), of the holographic playback from the hologram E. The angle of component 3 is $$2\alpha-\beta=270+3\theta \quad (4)$$

Therefore, if $\theta>30°$, component 3 will emerge from the hologram on the same side as the exciting beam A. The holographic interference fringe pattern spacing if A and B are plane waves is $$w=\frac{\lambda}{2\sin\theta} \quad (5)$$

and for $\theta=30°$, $w=\lambda$; and in the limit where $\theta=90°$ we see that $w=\lambda/2$. For optical frequencies, this represents a serious recording problem, and, in general, beam 3 is attenuated in optical holograms. However, at very high radio frequencies this represents no problem and is desirable from a recording point of view.

Figure 4A:
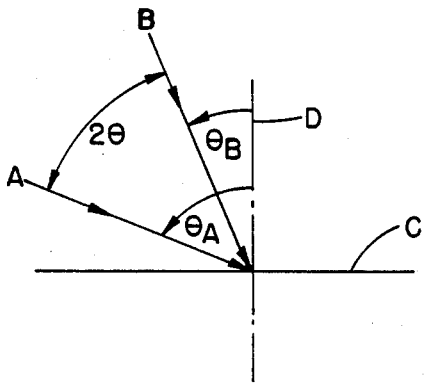
FIGS. 4*a* and 4*b* are vector diagrams showing recording and reconstruction where the recording beams are on the same side of the normal to the recording medium.
Figure 4B:
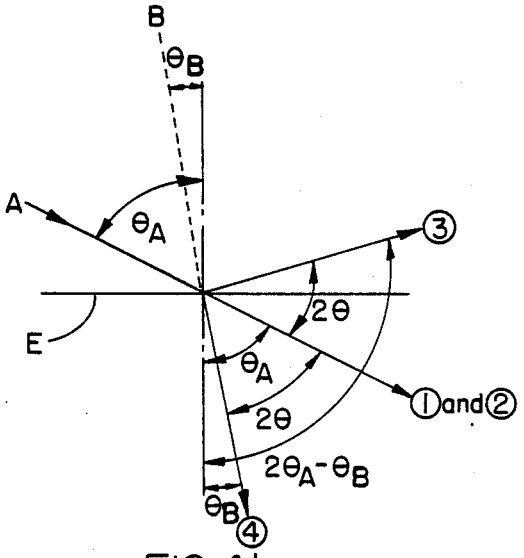

The two recording beams need not be equally disposed on each side of the normal to the holographic plane, as shown in FIGS. 4*a* and 4*b*. In FIG. 4*a*, the following angles can be expressed as:

$$2\theta=\theta_A-\theta_B$$

$$\alpha=270+\theta_A$$

$$\beta=270+\theta_B$$

In general, beams 1 and 2 can be considered the zero order beam, in the same direction as beam A and beams 3 and 4 can be considered the two first order playback beams, which are at an angle 20 either side of the zero order beam. The angle of the component 3 on playback is:

$$2\alpha-\beta=270+2\theta_A-\theta_B$$

Figure 5:
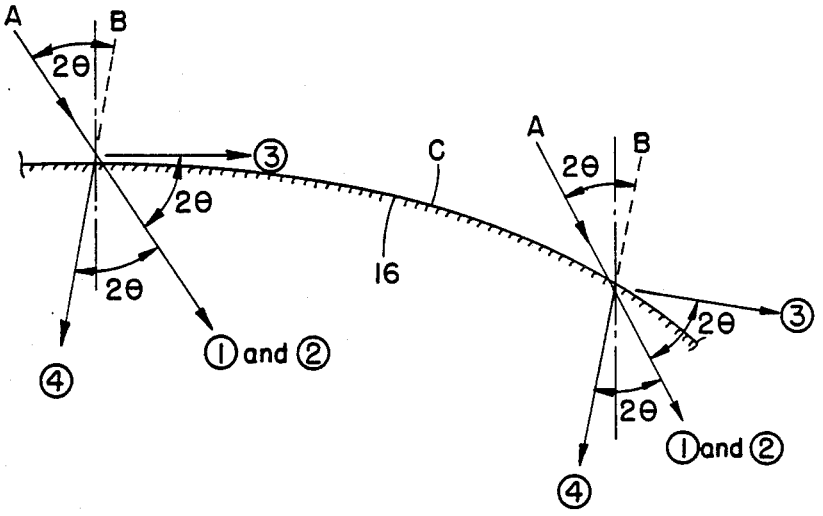
FIG. 5 is a vector diagram showing the reconstruction of the interference pattern on two separate areas of the aircraft skin.

If the holographic film C is not a plane surface but rather the shape of the skin of the aircraft 16, it follows from FIGS. 3 and 4 as we see in FIG. 5 that all vectors with the same label are parallel regardless of skin curvature. Note that the holograms at the two locations of FIG. 5 on aircraft 16 will be different but the resultant beam 3 will be as shown. The angle of vector A must therefore be selected so that beam 3 is always reflected out of the hologram.

Figure 6A:
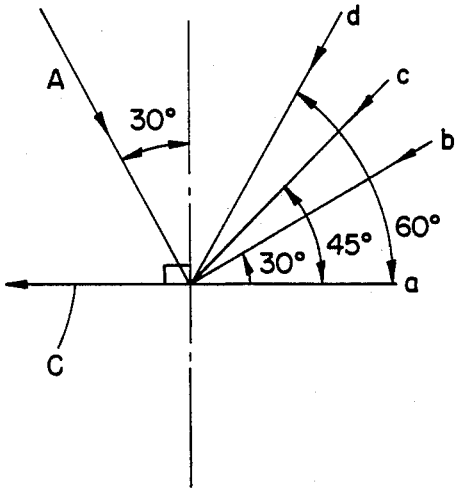
FIGS. 6*a* and 6*b* are vector diagrams wherein one of the recording beams is a phased array.
Figure 6B:
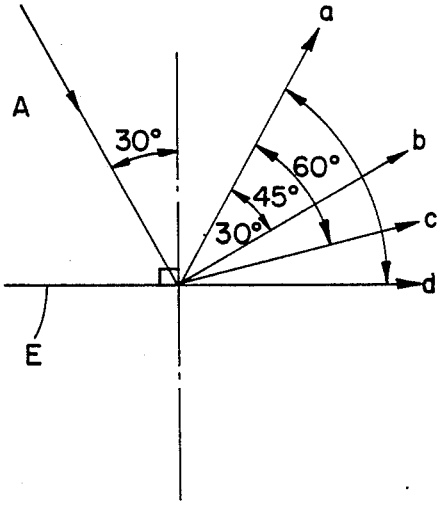

Beam B can be a composite of several beams taken collectively or recorded one at a time as shown in FIG. 6*a* as beams a, b, c and d. On playback, the order of the beams is reversed as well as their direction, but the relative spacing is conserved as seen in FIG. 6*b*. Therefore, phased arrays can be holographically recorded by this process.

Figure 7B:
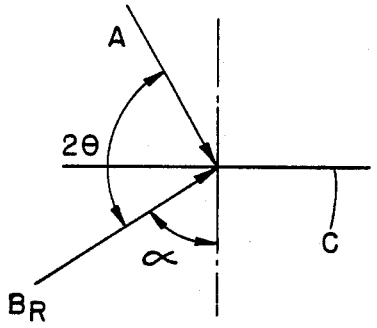
FIGS. 7*b* and 7*c* are vector diagrams showing the recording and reconstruction of the wave fronts of a recording beam and a skin reflecting beam.
Figure 7C:
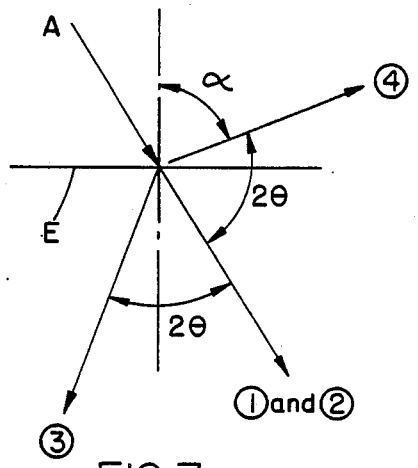
Figure 7A:
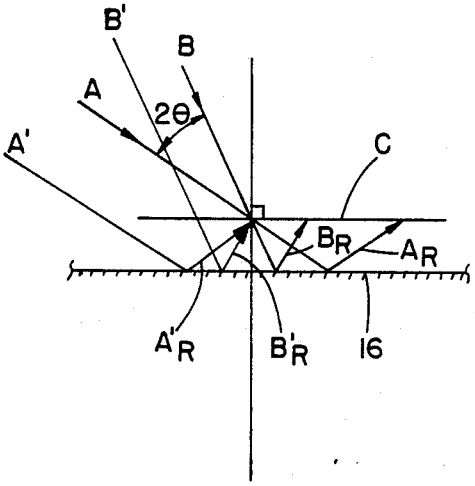
FIGS. 7*a* and 7*d* are vector diagrams showing the recording and reconstruction of the hologram interference pattern wherein one of the recording beams is a phased array and the beams are reflected off the aircraft skin.

As shown in FIG. 7*a*, the recording beams A and B will be reflected off the aircraft skin 16 during recording.

Figure 7D:
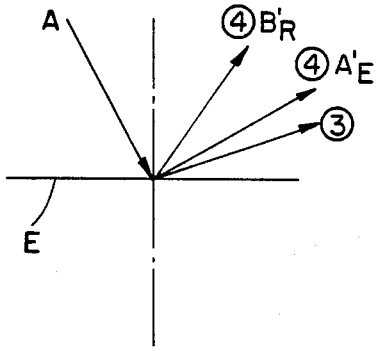

The aircraft skin reflected beams are labeled $A_R$ $A'_R$ and $B_R$ $B'_R$ in FIG. 7*a* and will generate interference patterns with both beams A and B. Since the playback exciting beam is beam A, we consider only this case. However, an exciting beam along direction B will generate beams on playback in a similar manner. The fact that beam A and the reflected beams $A_R$ $A'_R$ and $B_R$ $B'_R$ are on opposite sides of the holographic plate C does not alter the results of equation (3) as FIG. 7*b* indicates. However, the beam generated by the hologram E that is directed away from the aircraft is seen to be term 4 of equation (3) as shown in FIG. 7*c*. Therefore, on playback, FIG. 7*d*, there will be three beams generated; one beam 3 of FIG. 4*b* and two will be generated as shown in FIG. 7*a* from skin reflections as beam 4 of FIG. 7*c*. This fact together with the concept of multibeams of FIG. 6 can result in omnidirectional coverage. For single beam operation, some of these beams can be cancelled or altered. For example, by arranging $\theta$ less than 30°, beam 3 of FIG. 4*b* can be eliminated. There need be no constraint on beam A in that it too can consist of several beams both in the recording and playback.

Since terms 3 and 4 of equation (3) are the beams that are radiated on playback, their amplitude distribution in a transverse plane will provide the shape of the beam pattern. Both terms (3) and (4) of equation (3) have amplitudes of $|A|^2\ |B|$. If both A and B are plane waves of infinite extent (no constraint on the size of the aircraft), then $|A|^2\ |B|$ is a plane wave of infinite extent and the radiation pattern will be a delta function (normal to the plane wave) or needle beam. For a plane wave of finite extent the beam pattern will be that of a (sin x)/x function with the beam width varying reciprocally in each transverse direction to the extent of the plane wave in that direction. If beams A or B are not infinite and not plane waves, as they generally will not be, then the beam pattern will broaden, and minor lobes will appear beyond that of a (sin x)/x pattern for the same input beam cross section.

Generally, beam $4A'_R$ of FIG. 7 will not be recorded in the hologram because the holographic film along the aircraft skin must be very thin. This can be seen from FIG. 8*b* where the interference fringes F become parallel to the film C for beams A and $A_R$. Since $\lambda/2$ is greater than the film thickness, only one fringe will be recorded, and beam $4A'_R$ will not provide holographic playback.

Figure 8A:
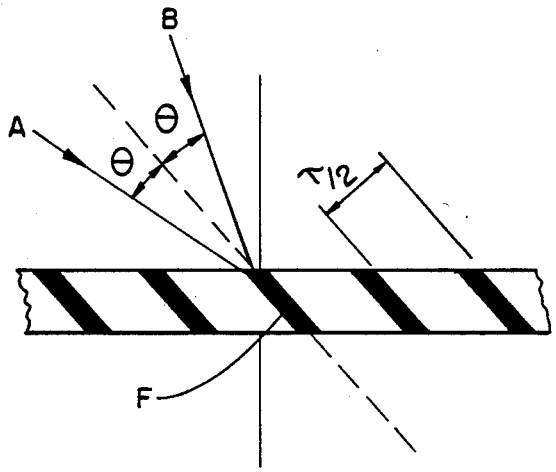
FIGS. 8*a* and 8*b* schematically show the interference fringes for two recording arrangements.
Figure 8B:
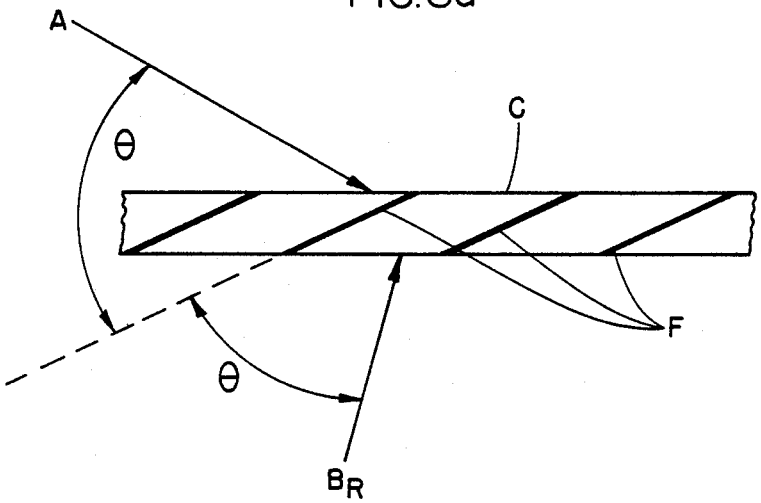

The fringes F shown in FIGS. 8*a* and 8*b* are sinusoidal but are shown as concentrated areas for clarity. The $\lambda/2$ spacing of the fringes depends on the frequency beam angles and on the velocity of propagation of the beams in the holographic film and can be reduced slightly by using a holographic film with a high dielectric constant.

The exciting beam A can be generated by flush mounted microwave horns or dipoles permanently mounted on the aircraft and used for fabrication and playback. Playback is equivalent to RF transmission where the transmitted RF output is fed to beam A and is generated into beams 4 and/or 3 for radiation from the aircraft. Since the antenna is reciprocal, it can be used for RF reception by taking the input beam 4 and/or 3 and generating beam A that is fed to an RF receiver.

Skin reflections on playback can also be used to increase the efficiency of the antenna but phasing of the directly generated and reflected beam must not destructively interfere. For example, in FIG. 3*b*, beam 4 will be reflected back along A, but beams 1 and 2 will be reflected at $(-\theta)$ to the normal to generate a beam in the same direction as $4A'_R$ in FIG. 7*d*. Beam 3 and beams 1 and 2 in FIG. 7*c* will also be reflected away from the aircraft skin.

To fabricate the holographic antenna 10, the holographic recording medium is mounted onto the aircraft 16 and is placed in an anechoic chamber 20 as shown in FIG. 2. One or more antennas such as horns or dipoles 18, flush mounted permanently on the wings and fuselage of the aircraft 16, will illuminate the entire aircraft and collectively provide one of the two holographic recording beams, preferably beam A. The other beam, beam B, will be generated from one or more horns or dipoles 22 mounted along the walls of the anechoic chamber 20. The horns 18 and 22 are excited from the same radio frequency source. The radio frequency beam generated from the anechoic walls is also directed at the holographic recording medium on the aircraft skin. The interference pattern of the two radio frequency beams is recorded on the holographic recording medium. As described earlier, this interference pattern includes a series of fringes. The recording medium is removed from the aircraft, and the interference pattern is then mapped by any suitable optical technique so that the particular fringes can be seen. A print of the interference pattern is made that can be cut in accordance with the fringes. Using the optically mapped interferences pattern, the plurality of thin dielectric strips 12 are secured to the skin of the aircraft so that the entire body of the aircraft becomes the antenna. The excitation of the hologram by the flush mounted horn antennas will result in the transmission of a radio frequency signal reflected out of the hologram.

The recording media can be any suitable material that is responsive to waves in the radio frequency range. The media will undergo a change of state, such as in optical density, color density, opacity or the like when contacted by an incident radio frequency wave. Examples of photographic emulsions now used to form holograms are photochromics, photoresists, photopolymers, thermoplastics and pre-exposed color film. However, the present invention should not be limited to these materials.

In one embodiment, the recording medium includes photochromic materials, and the interference pattern is mapped utilizing the temperature dependence of the color fading of the photochromic materials. In this technique, the two radio frequency beams are directed at a photochromic film, which has been color activated. The radio frequency energy beams heat the film corresponding to the interference pattern. The heated photochromic then cools, with the heated portions fading faster so that the interference pattern can be seen as a color density pattern on the film. A contact high contrast print is then made of the color density pattern thereby obtaining a permanent record of the fringes.

After the photographic image is formed, photoengraving may be used to transfer the pattern from the high contrast film to orient the dielectric strips 12 to form the hologram.

In a second technique, the interference pattern is mapped on a pre-exposed photographic color film undergoing development. The radio frequency fringes selectively heat portions of the film undergoing development resulting in differential development of the image which maps the interference pattern. The interference pattern is then copied onto a high contrast black and white film. A negative of the interference pattern is made from the black and white film which is used for photoengraving the dielectric strips 12 onto the skin of the aircraft. Flame spraying of the dielectric through a mask made of the reciprocal of the hologram can also be used. The present invention is not limited to the mapping techniques described herein, as any suitable technique may be used such as the mechanical scanning by a horn antenna.

If an omnidirectional pattern is desired, the wall radiation will be arranged for equal signal strength for all directions toward the aircraft. If a narrow sharp beam pattern is desired in a given direction, then the chamber wall radiation will be arranged to propagate a plane wave toward the aircraft at that direction or heading, for beam 4 output or at the correct heading for beam 3 output. If a scanning pattern over a sector or over 360° in azimuth is desired, a multiple exposure hologram can be fabricated in several steps. Each step would be a hologram of a single plane wave from a single heading from the wall of the anechoic chamber, and only those horns on the aircraft will be excited that illuminate the same part of the aircraft as the plane wave from the anechoic chamber wall. As the plane wave is stepped around the aircraft from different headings, a different set of horns on the aircraft will be excited. The hologram will be a multiexposure holographic film. In operation, a set of horns will be excited to generate a specific beam, and as the various combinations of horns are sequentially excited, the beam can be made to sequentially scan in azimuth.

Due to the curvature of the aircraft skin, there will always be some locations where the fringes are parallel to the holographic film (see FIG. 8) which will not be recorded, and there will be locations where beam 3 will be directed towards the aircraft skin rather than away from the aircraft. To circumvent these problems, two or more exciting antennas (horns or dipoles to generate beam A) illuminating the same part of the aircraft from different directions will provide useful fringes over all of the aircraft skin.

Figure 9:
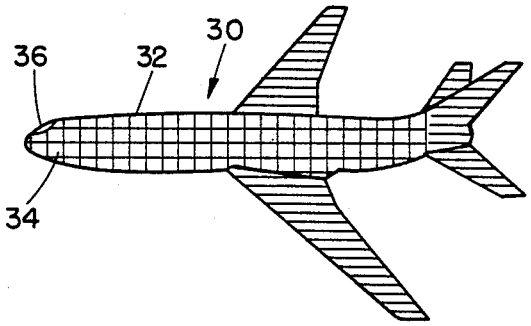
FIG. 9 is a schematic of an aircraft including the radar reduction device of the present invention.

The techniques of the present invention can also be used to provide a radar reduction device 30 of FIG. 9. Under this condition of operation the beam that will illuminate the aircraft is the interrogating enemy radar. The radar illumination can arrive from any direction. For this type of application, it is desirable to have the skin mounted hologram form very fine gratings 32 that are oriented orthogonal to the longitudinal dimensions of the wings and fuselage as shown by way of example in FIG. 9. The gratings 32 are secured as a dielectric material 34 that is contoured and mounted on the skin of the aircraft 36. If the hologram represents a very fihe grating, the two first order beams can be transmitted almost parallel to the aircraft skin and the grating to ultimately be dissipated in the aircraft skin. For this type of application, the gratings 12 may be made of a lossy dielectric film material to provide additional attenuation of the surface wave to minimize reflection off the aircraft back to the interrogating radar. Several layers of gratings with different orientations or superimposed holograms in a single layer can be made to accommodate a wide range of angles of arrival of the radar illumination.

Fabrication of the grating hologram can be made by placing the aircraft in an anechoic chamber, and the two beams will consist of one from the walls of the chamber to simulate the radar and the other can be a surface launched wave along the aircraft skin. Interdigital fingers for launching the surface wave can be removed before the hologram is placed on the skin of the aircraft. The radar beam can arrive at the aircraft from several directions at once. Several superimposed holograms can be made at different frequencies to accommodate several bands of known radar frequencies. Before the developed hologram is mounted in place, the aircraft skin can be painted with a conductive paint that has a surface resistance in the range of 350–400 ohms per square to insure absorption of the surface wave generated by the illuminating radar. A paint having a surface resistance of 377 ohms per square is preferable.

While illustrative embodiments of the subject invention have been described and illustrated, it is obvious that various changes and modifications can be made therein without departing from the spirit of the present invention which should be limited only by the scope of the appended claims.

What is claimed is:

1. A holographic aircraft antenna comprising a thin layer of strip elements contoured to and secured to the skin of the aircraft, the spacing and width of said thin layer of strip elements are determined by an interference pattern of first and second radio frequency beams recorded on a holographic recording medium thereby forming a hologram to yield the desired radio frequency radiation pattern, said hologram being fabricated such that excitation of said hologram from a radio frequency source mounted to said aircraft will result in the transmission of a radio frequency signal reflected out of said hologram.

2. The antenna of claim 1 wherein said thin layer of strip elements are secured to said aircraft corresponding to the fringes of said interference pattern.

3. The antenna of claims 1 or 2 wherein said thin layer of strip elements are secured to said aircraft skin by embedding said strips within said aircraft skin.

4. The antenna of claim 3 wherein said strip elements are made of dielectric material and the aircraft skin is made of conductive materials.

5. The antenna of claim 3 wherein said strip elements are metal conducting strips and the aircraft skin is made of composite materials.

6. The antenna of claim 1 wherein said recording medium includes photochromic materials.

7. The antenna of claim 1 wherein the recording medium is pre-exposed photographic color film.

8. The antenna of claim 7 wherein said hologram is formed by mapping said interference pattern on said pre-exposed photographic color film, copying said interference pattern on high contrast black and white film, obtaining a negative of said interference pattern and using said negative for photoengraving said dielectric or metal conducting strips onto said aircraft skin corresponding to said interference pattern.

9. The antenna of claim 1 wherein said hologram is formed by mounting said holographic recording medium to the skin of the aircraft;

placing the aircraft in an anechoic chamber;

directing a first radio frequency beam onto said holographic recording medium, said first radio frequency beam being generated from one or more antennas flush mounted to said aircraft;

directing a second radio frequency beam, generated from the same source of radio frequency, onto said holographic recording medium, said second radio frequency beam being generated from one or more antennas mounted to the walls of said anechoic chamber;

recording said interference pattern on said holographic recording medium;

removing said recording medium and mapping the fringes of said interference patterns; and securing said strip elements to said aircraft skin corresponding to said fringes.

10. The antenna of claim 9 wherein the flush mounted and wall mounted antennas are feed horns.

11. The antenna of claims 9 or 10 wherein two or more flush mounted antennas generate beams that are directed to the same part of the aircraft from different directions.

12. The antenna of claim 10 wherein said holographic recording medium is a multiexposure film, and said interference pattern is formed in sequential steps wherein each step consists of a single beam from a single wall mounted antenna and the beam from the flush mounted antennas focused on the area of the aircraft receiving the single beam, thereby forming a holographic pattern that can be used as a scanning radiation pattern.

13. The antenna of claim 10 wherein said second radio frequency beam is a phased array consisting of several beams generated from said plurality of wall mounted antennas.

14. The antenna of claim 9 wherein the flush mounted and wall mounted antennas are dipoles.

15. The antenna of claim 9 wherein said second radio frequency beam is generated from a plurality of wall mounted antennas arranged for equal signal strength for all directions toward the aircraft thereby forming an omnidirectional interference pattern.

16. The antenna of claims 1 or 9 wherein said interference pattern is mapped by the temperature dependence of the color fading of a photochromic film.

17. The antenna of claim 16 wherein said interference pattern is mapped by directing said two radio frequency beams at a photochromic film which has been color activated thereby heating said photochromic film corresponding to said interference pattern, allowing said heated photochromic film to cool whereby the color of said photochromic film will fade faster in the heated portions so that said interference pattern can be seen as a color density pattern on said photochromic film, and obtaining a permanent record of said interference pattern by making a high contrast contact print of said color density pattern.

18. The antenna of claims 1 or 9 wherein said interference pattern is mapped by mechanical scanning of a horn antenna.

19. The antenna of claims 2 or 9 wherein the angle of said first radio frequency beam with respect to the normal to said holographic recording medium is selected such that said transmitted radio frequency signal will always be reflected out of said hologram.

20. A method of fabricating a holographic aircraft antenna comprising:

mounting a holographic recording medium to the skin of the aircraft;

placing the aircraft in an anechoic chamber;

directing a first radio frequency beam onto said holographic recording medium, said first radio frequency beam being generated from one or more antennas mounted on said aircraft;

directing a second radio frequency beam, generated from the same source of radio frequency, onto said holographic recording medium that intersects said first radio frequency beam in a stationary interference pattern, said second radio frequency beam being generated from one or more antennas mounted to the walls of said anechoic chamber;

recording said interference pattern on said holographic recording medium, said interference pattern including a series of fringes;

removing said recording medium and mapping said intcrference pattern;

securing a plurality of thin strip elements to said aircraft skin corresponding to said fringes thereby forming a copy of the recorded hologram to yield the desired antenna radiation pattern; and mounting said hologram to the skin of the aircraft whereby excitation of said hologram by said aircraft mounted antennas will result in the transmission of a radio frequency signal reflected out of said hologram.

21. The method of claim 20 wherein said recording medium includes photochromic materials, and said interference pattern is mapped by utilizing the temperature dependence of the color fading of said photochromic materials.

22. The method of claim 21 wherein said interference pattern is mapped by directing said two radio frequency beams at a photochromic film, thereby color activating and heating said photochromic film corresponding to said interference pattern, allowing said heated photochromic film to cool, whereby the color of said photochromic film will fade faster in the heated portions so that said interference pattern can be seen as a color density pattern on said photochromic film and obtaining a permanent record of said color density pattern by making a contact print.

23. The method of claim 20 wherein said interference pattern is mapped on a pre-exposed photographic color film.

24. The method of claim 23 wherein the step of securing said strip elements includes copying said interference pattern from said photographic film onto a high contrast black and white film, obtaining a negative of said interference pattern and using said negative for photoengraving said strip elements to said aircraft skin corresponding to said fringes.

25. The method of claim 20 wherein said interference pattern is mapped by mechanical scanning of a horn antenna.

26. The method of claim 20 wherein the angle of said first radio frequency beam with respect to the normal to said holographic recording medium is selected such that said transmitted radio frequency signal will always be reflected out of said hologram.

27. The method of claim 20 wherein the flush mounted and wall mounted antennas are feed horns.

28. The method of claim 20 wherein the flush mounted and wall mounted antennas are dipoles.

29. The method of claim 20 wherein said second radio frequency beam is generated from a plurality of wall mounted antennas arranged for equal signal strength for all directions toward the aircraft thereby forming an omnidirectional interference pattern.

30. The method of claim 20 wherein said holographic recording medium is a multiexposure film, and said interference pattern is formed in sequential steps wherein each step consists of a single beam from a single wall mounted antenna and the beam from the flush mounted antennas focused on the area of the aircraft receiving the single beam, thereby forming a copy of the recorded hologram to yield the desired scanning radiation pattern.

31. The method of claim 20 wherein two or more aircraft flush mounted antennas generate beams that are directed to the same part of the aircraft from different directions.

32. The method of claim 20 wherein said second radio frequency beam is a phased array consisting of several beams generated from said plurality of wall mounted antennas.

33. The method of claim 20 wherein said holographic recording medium is spaced from said aircraft skin, whereby said first and second radio frequency signals will reflect from said aircraft skin and generate further interference patterns such that upon excitation of said hologram there will be a plurality of beams emerging from said hologram, thereby providing omnidirectional radio communication coverage.

34. The method of claim 20 wherein said strip elements are made of dielectric material.

35. The method of claim 20 wherein said strip elements are metal conducting strips.

36. A radar reduction device for an aircraft comprising:

a thin layer of strip elements contoured to and mounted on the skin of the aircraft in a spaced relationship in accordance with an interference pattern of first and second simulated radar beams thereby forming a diffraction grating whereby the reception of a radar beam by said grating will result in a portion of said radar beam being redirected along the skin of the aircraft and being dissipated, thereby providing minimum reflection of said radar beam to reduce the size of the aircraft as detected by the radar beam.

37. The device of claim 36 wherein said diffraction grating is orthogonally oriented with respect to the longitudinal axes of the wings and fuselage of the aircraft.

38. The device of claim 36 wherein the aircraft skin is coated with a lossy material to dissipate the entrapped surface wave.

39. The device of claim 36 further including a plurality of diffraction gratings formed at different frequencies, said gratings being superimposed on each other to accommodate a plurality of radar frequencies.

40. The device of claim 36 wherein said grating is formed by:

mounting said holographic recording medium to the skin of the aircraft;

placing the aircraft in an anechoic chamber;

directing a first simulated radar beam onto said holographic recording medium, said first simulated radar beam being surface waves generated from one or more antennas flush mounted to said aircraft of interdigital types;

directing a second simulated radar beam, from the same source of radio frequency, onto said holographic recording medium, said second simulated radar beam being generated from one or more antennas mounted to the walls of said anechoic chamber;

recording said stationary interference pattern on said holographic recording medium;

removing said recording medium and mapping the fringes of said interference pattern; and securing said thin strip element to the aircraft skin corresponding to said fringes.

41. The device of claim 40 wherein said interference pattern is mapped by the temperature dependence of the color fading of a photochromic film.

42. The device of claim 40 wherein said interference pattern is mapped by mechanical scanning of a horn antenna.

43. The device of claim 36 wherein said aircraft skin includes a conductive paint having a surface resistance in the range of 350–400 ohms per square inch.

44. The radar reduction device of claim 36 wherein said strip elements are made of dielectric material and the skin of the aircraft is made of a conductive material.

45. The radar reduction device of claim 36 wherein said strip elements are metal conducting strips and the skin of the aircraft is made of composite materials.

46. A method of fabricating a holographic radar reduction device comprising:

mounting a holographic recording medium to the skin of the aircraft;

placing the aircraft in an anechoic chamber;

directing a first simulated radar beam (surface wave) onto said holographic recording medium, said first simulated radar beam being generated from one or more antennas, of the interdigital finger type, flush mounted to said aircraft;

directing a second simulated radar beam from the same source of radio frequency, onto said holographic recording medium that intersects said first radar beam in an interference pattern, said second radar beam being generated from one or more antennas mounted to the walls of said anechoic chamber;

recording said interference pattern on said holographic recording medium, said stationary interference pattern including a series of fringes;

removing said recording medium and mapping said interference pattern;

securing a plurality of thin dielectric strips to the conductive aircraft skin corresponding to said fringes thereby forming a diffraction grating; and mounting said grating to the skin of the aircraft whereby the reception of a radar beam by said grating will result in a portion of said radar beam being redirected as a surface wave that will be dissipated along the aircraft skin, thereby providing minimum reflection of said radar beam to reduce the size of the aircraft as detected by the radar beam.

47. The method of claim 46 wherein said diffraction grating is oriented with respect to the aircraft to provide a redirected surface wave along the longitudinal axes of the wings and fuselage of the aircraft.

48. The method of claim 46 wherein the aircraft skin surface is made of a lossy material.

49. A holographic aircraft antenna comprising:

an aircraft having a skin being made of a dielectric material, and a plurality of thin metal conducting strips secured to said dielectric skin material corresponding to the desired radio frequency hologram pattern thereby forming a hologram, said hologram being fabricated such that excitation of said hologram from a radio frequency source mounted to said aircraft will result in the transmission of a radio frequency signal reflected out of said hologram.

50. The antenna of claim 49 wherein said dielectric skin material is made of composite material.

* * * * *